United States Patent [19]

Simon et al.

[11] 4,297,099

[45] Oct. 27, 1981

[54] PROCESS FOR THE PRODUCTION OF A SYNTHETIC RESIN SHEET MATERIAL WHICH IS DYED UNICOLORED OR MULTICOLORED IN ACCORDANCE WITH A PATTERN

[75] Inventors: Manfred Simon, Nieder-Kassel; Erwin Möschter, Neunkirchen Seelscheid; Karl-Heinz Spiess, Konigswinter; Richard Weiss, Troisdorf, all of Fed. Rep. of Germany

[73] Assignee: Dynamit Nobel Aktiengesellschaft, Troisdorf, Fed. Rep. of Germany

[21] Appl. No.: 961,012

[22] Filed: Nov. 15, 1978

[30] Foreign Application Priority Data

Nov. 15, 1977 [DE] Fed. Rep. of Germany ..... 2750984

[51] Int. Cl.[3] ..... D06P 5/02

[52] U.S. Cl. ..... 8/484; 8/506; 8/508

[58] Field of Search ..... 8/4, 5, 506, 484, 508; 427/301, 302, 303, 256, 393.5, 44

[56] References Cited

U.S. PATENT DOCUMENTS

| | | | |
|---|---|---|---|
| 3,337,288 | 8/1967 | Horiguchi et al. | 8/4 |
| 3,619,103 | 11/1971 | Williams et al. | 8/503 X |
| 3,625,731 | 12/1971 | Taylor | 8/4 X |
| 3,627,472 | 12/1971 | Parsons et al. | 8/4 |

*Primary Examiner*—Evan K. Lawrence

*Attorney, Agent, or Firm*—Craig and Antonelli

[57] ABSTRACT

A process for producing colored synthetic resin sheet material having a unicolored or multicolored dye coating applied to one surface thereof and extending into said surface in a uniform manner involves applying a dye-containing material or composition to at least one selective portion of the surface of a synthetic resin sheet material that contains at least one reactive, crosslinkable component, where the dye-containing material is capable of migrating into a non-porous sheet formed of the synthetic resin; controlling the migration of the dye material into the sheet material to a desired depth; and then initiating crosslinking of the crosslinkable component to stop further migration of the dye-containing material.

27 Claims, 1 Drawing Figure

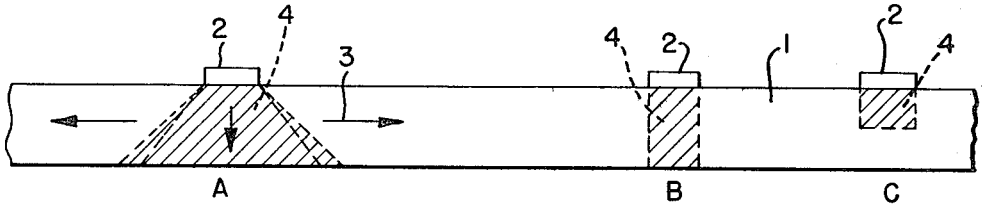
2
4
3
4
2
1
2
4
A
B
C

PROCESS FOR THE PRODUCTION OF A SYNTHETIC RESIN SHEET MATERIAL WHICH IS DYED UNICOLORED OR MULTICOLORED IN ACCORDANCE WITH A PATTERN

The invention relates to a process for the production of a synthetic resin sheet material dyed unicolored or multicolored which can be the top surface of a molded article wherein the dyes are applied to the surface.

It is known to manufacture synthetic resin sheet material, for example floor coverings, according to the calendering method with a multicolored marbling which extends throughout the material. However, in this method the marbled structure is aligned in longitudinal orientation by the calendering process and cannot be selectively altered to any desired design by changing the process correspondingly. Moreover, it is known to impart any desired design to molded articles, such as sheets, films, or panels of synthetic resin by imprinting the surface. However, in this printing method the abrasion resistance of the dyes imprinted on the synthetic resin surface is low since the dye application is only very thin, and the dyes cannot penetrate into the synthetic resin material. To obtain a longer useful life when utilizing the printing technique, and to protect the printing ink against abrasion, a transparent cover layer is, therefore, frequently provided on top of the imprinted pattern. In such products, the useful life is determined by the thickness of the transparent cover layer, since after the abrasion of the latter the imprinted pattern is again prone to destruction.

The conventional processes for the manufacture of sheet material and like flat articles of synthetic resin having a unicolor or multicolored design thus are either limited by the given process technology, (for example calendering, extrusion, etc.), with respect to the designing possibilities, or result in a restriction of the desired physical and mechanical properties in case the design can be freely selected, such as in the printing technique, for example, since the pattern is present merely in a minor thickness corresponding to the ink application. The latter is especially apparent in those products which are subject to extensive effects of wear and tear during later usage on the patterned surface, for example floor coverings, balls for games and sports, etc.

It is known from DAS [German Published Application] No. 2,459,791 to apply patterns to a sheet material of synthetic resin by means of the sublimation pressure method. To attain a certain deep-reaching effect and thus a thorough dyeing of the sheet material, a porous synthetic resin layer has to be employed for this purpose so that the sublimated dye has the possibility to infiltrate into the porous material. However, if this conventional method is used in sheet materials with a compact outer synthetic resin layer there cannot be obtained a deep-reaching dyeing.

This invention is based on the problem of providing a process for the manufacture of synthetic resin sheet material with a unicolored or multicolored pattern, which exhibits the advantages of the heretofore known printing methods, namely the subsequent application of coloring agents to the surface of the synthetic resin in any desired, even unicolored, patterning, and avoids their disadvantages of a small layer thickness.

This problem is solved in accordance with the invention by providing a process wherein dyes capable of migration into a non-porous synthetic resin sheet material are used for the color application and at least one reactive, crosslinkable component is utilized in forming the sheet material, with the migration of the thus-applied dyes then taking place into the sheet material controllably to the desired depth of penetration and thereafter the reaction leading to crosslinking of the reactive component is initiated, so that further dye migration is stopped by the crosslinking of the reactive component.

The process of this invention makes it possible to produce a sheet material dyed in a pattern by applying the dyes in any desired design, even in a unicolored one, to the surface of the sheet material. In this connection, the design can be produced in the sheet material in a varying thickness; the depth of penetration of the pattern can also include the complete penetration of the sheet material. This eliminates the disadvantages of a small application thickness of printed patterns. The lifetime of a product dyed in accordance with this invention, which is, for example, exposed to vigorous abrasion now is dependent on the useful life of the sheet material itself, rather than on the abrasion resistance of the print or of a transparent cover layer disposed on top thereof. It is possible by means of this invention to produce by imprinting on sheet materials, in a free selection of designs, sheet materials (or molded articles obtained from the sheet materials) wherein the design can extend throughout. The process of this invention can be employed with special advantage in large-area products manufactured, for example, by calendering, rolling, extrusion, or by the spread-coating method. Examples in this connection are decorative sheets or coverings for floors or walls. The sheet materials patterned in accordance with the invention can be part of a single-layer or multiple-layer composite article, e.g. bonded coverings for floors. In this case, the dyed sheet material forms the decorative use surface and the underside of the sheet material is bonded, for example, to a foam layer and/or optionally to additional, also cloth-reinforced layers.

Suitable for the synthetic resin sheet materials to be produced in accordance with the invention are essentially molding compositions containing hardenable or thermoplastic synthetic resins, optionally with auxiliary agents, or mixtures of hardenable or thermoplastic synthetic resins with fillers and/or reinforcing agents and optionally additional auxiliary substances, such as stabilizers, mold release agents, plasticizers, pigments, etc. The sheet materials are manufactured, in this connection, from the molding compositions by molding within specific temperature ranges, such as calendering, rolling, extrusion, injection-molding, compression molding, spread-coating, etc. It is also possible to process expandable molding compositions, so that sheet materials consisting of synthetic resin foam are produced.

Thermoplastic synthetic resins are preferably utilized for the sheet materials, for example those on the basis of polyvinyl chloride, polyolefins, styrene polymers, acrylic resins, polyacetals, polycarbonates. However, likewise usable are elastomers on the basis of natural or synthetic rubber and synthetic resins comparable thereto, as well as other synthetic resinous materials, e.g. polyester resin, alkyd resins, and silicones. Moreover, mixtures of various plastics can also be employed.

The tendency of some dyes to migrate from one layer into an adjoining other layer of synthetic resin is known and is called bleeding or migration. The invention, now, exploits this conventional capability of many dyes of migrating in order to solve the initially posed problem of a thorough dyeing, i.e. a dyeing effect which penetrates the sheet material, by means of a superficially applied, optionally patterned, dye application. In a further development of the invention, it has been found that the extent of the migration, i.e. the size of the area dyed by the migration of the dyes and also the migrating velocity can be affected by a number of factors and is controllable. In this connection, the type and amount of the dyes selected are above all of importance, as well as the type and amount of the plasticizers used, the type and amount of the reactive, crosslinkable component, the temperature control during the manufacturing process, furthermore also certain fillers, and also the methods of manufacturing the sheet materials, all of which affect the extent of migration and the migrating velocity.

Advantageously usable for the process of this invention are organic dyes tending to migrate especially soluble organic dyes, whereby the dyes are considered to be soluble in organic solvents like ketones, esters or aromatics. Preferably utilized are dyes such as perylenetetracarboxylic acid derivatives, quinacridones, indanthrene dyes, chlorobenzidine products coupled onto acetoacetanilides or pyrazolones, azo pigments, and others; or organic dyes, such as acridine dyes, aniline black, anthraquinone, azine or azo dyes, azomethine dyes, benzo- and naphthoquinone dyes, quinophthalones, indigoid dyes, indiphenols, indoanilines, indamines, leuco vat dye esters (anthrasols, indigosols, leucosols), naphthalimides, nigresines, "Indulins", oxazine and dioxazine dyes, oxidation dyes, phthalocyanines, polymethine dyes, sulfide dyes, tri- and diarylmethane dyes, thiazine, thiazone, and xanthene dyes. The most preferred dyes are anthraguinone dyes, azo dyes and diazo dyes.

The dye concentration or the amount of the dye employed and thus also the magnitude and thickness of the dye application on the sheet material play a part when carrying out the invention insofar as a larger amount of dye utilized for a pattern surface of the same size shows a somewhat enhanced migration effect. However, in the final analysis it is dependent on the individual case how many dyes are utilized, since this is also dependent on the color, strength of color, etc. desirable from a purely optical viewpoint, see table II and example 6.

The migration of the dyes can be promoted, for example, by providing that the dye is partially dissolved by a component of the adjoining layer and the migration and dyeing are accomplished in this way. However, the migration of the dyes can also be enhanced by suitable transporting agents, which themselves show great tendency toward migration, for instance, plasticizers. In this connection, combined processes can also occur. Especially suitable for such processes are soluble organic dyes. When more than one dye is used for a pattern, the chosen dyes should have the same migration velocity, to attain a uniform pattern in the depth and to avoid chromatographic effects.

In a further development of the process of this invention, it is therefore suggested to admix, to the sheet material or to the dyes to be applied, auxiliary agents which will partially dissolve the dyes, such as, for example, plasticizers, mold release agents, stabilizers, and others, so that the migration of the dyes is enhanced.

It has been found, for example, that plasticizers normally promote, though to varying degrees, the migration of dyes, particularly soluble organic dyes. It is, therefore, possible along the lines of this invention to add a plasticizer during a dye application in the form of a solution or dispersion or printing ink, so that this plasticizer has the effect of a transport agent for the dyes and effects their migration into the adjoining stratum of the sheet material. However, it is likewise possible by adding plasticizer to the synthetic resin of the sheet material to create from that direction a migrating effect on the dye. Also, a series of further auxiliary agents and additives to the synthetic resins, such as, for example, mold release agents or stabilizers, have a positive action on dye migration and can contribute along the lines of the invention toward causing a uniform migration of the dye applied to the sheet material into the latter. Advantageously the invention can be utilized for coloring soft PVC, wherein known plasticisers on the base of phthalate like butyl benzyl phthalate, dioctylphthalate, diisodecyl phthalate or adipates, like dioctyl adipate or sebacate like dioctylsebacate favor the migration of the dyes.

Moreover, it has been found that even some synthetic resins or reactive, crosslinkable components promote dye migration, and therefore, in a further development of the invention, it is suggested to utilize such synthetic resins and/or crosslinkable components promoting the dye migration, for example acrylates, in the sheet material and/or in the dye applied thereto. Acrylates can be provided for example, in the printing ink for the imprinting step and/or, alternatively, in the sheet material to be imprinted. Preferred acrylates are lauryl acrylate, hexanediol diacrylate, lauryl methacrylate.

In the embodiment of the invention, the dyes can be applied according to convention al methods to the surface of the sheet material, especially by printing. In this connection, especially suitable are direct printing methods, such as intaglio, copper-plate printing rotogravure, screen printing, stencil printing; likewise possible are transfer printing processes, such as, for example, the sublimation printing procedure. The dyes are applied in this connection, depending on the process technique or character of the sheet material, directly or in the form of a solution or dispersion. The preferred step of the invention to influence and control the migration of the dyes is the application of heat. In a further development of the process of this invention, the migration of the dyes can be accelerated and regulated by the supply of heat, wherein temperatures of 60°–220° C. are preferably utilized, where this factor also depends on the synthetic resins utilized for the sheet material. It has been found surprisingly that the dye concentration, namely the gradient of color concentration from the surface into the interior of the sheet material is made more uniform at an elevated temperature. The migration of the dyes proceeds normally, without any additional effects exerted by the temperature, from the surface into the interior of the sheet material and at the same time uniformly toward the sides, see FIG. 1A. Here again, it has been found surprisingly that, the higher the temperature is chosen for accelerating the migration of the dyes, the more clearyl does the migration direction point preferably into the depth of the sheet material; whereas the lateral migration is diminished, see FIGS. 1B and 1C. In this way, it is possible by supplying heat during the dye migration step to avoid the running of the colored patterns toward the side and to attain a uniform dye concentration also in the deep interior. The time of suppliying heat should be at least 1 min until 1 hour, preferably 2 to 30 min.

With a heat-evoked, increased migration velocity, the individual substances participating in the migration procedure show a different behavior, i.e. they effect differently great increases, i.e. synergistic effects are obtained. In this connection, the plasticizers are the primary agents which, at an elevated temperature, evoke, in part, a multiple of the dye migration velocity as compared to room temperature, see table III. Thus, it is possible by combining suitable, migration-promoting substances with migration-active dyes and heat supply to obtain an unforeseeable enormous acceleration of the migration process when conducting the mothod of this invention. The heat treatment of the sheet material, superficially provided with an application of a dye to promote the migration process of the dyes and thus the dyeing of the sheet material can be combined with a further process step during the manufacture of the sheet material, for example, a gelling process or a curing step.

To conduct the process of this invention, it is necessary to provide, besides the dyes capable of migrating, at least one crosslinkable component, wherein this component can be contained either in the sheet material and optionally also in the printing ink for the dye application. The crosslinkable component is used to stop the migration of the dyes by initiating the crosslinking. It has been surprisingly found, that the normally endless lasting migration of the dyes in the synthetic resin can be stopped, so that no lateral migration takes place, by at least partially crosslinking the synthetic resin material. Crosslinking is understood to mean the linking of molecules through primary valences into a three-dimensional network. Suitable to stop the migration of the dyes in the synthetic resins are different crosslinking methods. Crosslinking can be triggered chemically by the addition of suitable radical-forming molecules, e.g. by peroxides, or by vulcanization, or by irradiation with high-energy radiation, such as UV rays or electron rays. In this connection, when using UV radiation, it is possible to operate with the addition of photoactivators. Crosslinking can take place, for example, directly via polymeric components, or it can result, starting with monomeric components, from the polymerization thereof.

For purposes of the process of this invention, uncrosslinked reactive, monomeric, oligomeric and/or polymeric components are used initially which are then crosslinked after the dye migration in the desired manner has taken place, so that the three-dimensional network formed by these components blocks and prevents the further migration of the dyes. This has the effect that the originally two-dimensionally applied pattern penetrates into the sheet material and becomes a three-dimensional design.

Suitable reactive compounds capable of crosslinking are components which contain at least one double bond. Along the lines of this invention, preferred crosslinkable components employed are those which can be crosslinked by radiation, primarily by UV radiation or electron rays, and crosslinking is then initiated by irradiating the sheet material provided with a dye application. The crosslinking carried out by means of UV rays on correspondingly crosslinkable compounds is employed, in particular, for sheet materials of synthetic resins amenable to transparent dyeing. In this connection, it is also possible to add photoactivators to the sheet material. In contrast thereto, crosslinking with the aid of electron rays can be utilized for all dyeing operations and also for all nontransparent sheet materials, as long as correspondingly crosslinkage components are present. The use of radiation for initiating the crosslinking of the corresponding compounds has the advantage that the conductance of the process is simple. It is also possible to conduct the process of this invention with the use of a chemical crosslinking step, e.g. application of heat. However, in this case the compounds and dyes to be used must be adapted to one another in their reactions, and the temperature must be monitored during the molding of the sheet material so that the crosslinking reactions are not triggered prematurely. The use of chemically crosslinkable components is recommended for example, in the form of the synthetic resin and/or a part thereof for the sheet material. For example, plastic rubber types or EPDM can be utilized for the sheet material, together with vulcanizing agents, and a vulcanizing step (crosslinking step) can be conducted after the application and migration of the dyes.

The crosslinkable compounds, which must be present in accordance with the invention in the sheet material to be provided with a pattern or which has been provided with a design, in order to stop the migration of the dyes by their crosslinking reaction and thus to determine the final pattern, namely on top of the sheet material and in the interior thereof, can be added to the sheet material in various ways. One possibility resides in adding the crosslinkable component to the synthetic resin of the sheet material during the manufacture of the synthetic resin. If the proportion of the crosslinkable compounds has been added to the composition for producing the sheet material, care must be taken during the molding step required for obtaining the sheet material, that the temperatures are maintained at such a level that no crosslinking occurs as yet, so that such crosslinking can be initiated at a later point in time after the dye for the superficial pattern has been applied.

The amount of crosslinkable compounds which is added is dependent on the composition of the material used for the molded sheet article, especially also on the synthetic resins contained therein. The proportion of the crosslinkable compound in the total mass of the sheet material can be between 2% and 80% by weight, preferably between 2% and 20% by weight.

The crosslinkable compound to be utilized and also its weight proportion in percent are likewise dependent on the synthetic resin in the sheet material and on the desired properties of the final product. Since crosslinking usually entails an increase in strength, a decrease in solubility, and, at higher temperatures (above the glass transition temperature), rubber elasticity, these changes must in some cases also be taken into account and determine the crosslinkable compound respectively suitable for the final product, and also its weight proportion with regard to the sheet material in which it is incorporated. To obtain a guideline for the degree of crosslinking obtained and thus the extent of stoppage of migration of the dyes attained in this way, it is possible, for example, to measure the Shore hardness prior to and after the crosslinking, see example 5. The degree of crosslinking and thus the stoppage effect for the migration of the dyes obtainable in this manner is different in case of the various possible crosslinkable compounds that can be employed and, of course, also depends on the total composition of the sheet material. It has been found that an increase of the shore hardness of 5% measured as difference prior to and after the crosslinking is sufficient to finally stop the migration of the dyes.

On the other hand, it is also possible in accordance with the process of this invention to combine the crosslinkable compound additionally with the dyes and/or with the printing inks, pastes, dispersions, solutions which contain the dyes, and thus apply the crosslinkable compound to the surface of the sheet material together with such dyes.

It is also possible to utilize the crosslinkable component in the form of a crosslinkable synthetic resin for the sheet material. The synthetic resin is preferably selected from the group of plastics which can be crosslinked by radiation. Suitable for this purpose are, for example, the synthetic resins polypropylene, polystyrene, polyethylene, polyester, polybutadiene, polysiloxane, EPEM, natural or synthetic rubber, polyvinyl chloride, polyvinyl alcohol or a polyacrylate.

The sheet material can comprise only as a synthetic resin a crosslinkable component or a mixture of a crosslinkable component and a non-crosslinkable synthetic, preferably thermoplastic resin or a mixture of a crosslinkable component and a crosslinkable synthetic resin.

For use as the crosslinkable reactive component, those compounds are especially employed which contain at least one double bond.

All vinyl compounds can be utilized as the crosslinkable compound, especially a compound crosslinkable by radiation, for purposes of the process of this invention. Especially suitable are the unsaturated compounds selected from the group of the acrylates, but the invention is not limited thereto. Among the acrylates, suitable are preferably mono- as well as polyfunctional acrylates and/or methacrylates, as well as mixtures thereof. Also prepolymers can be used as the crosslinkable component in this invention.

From the group of compounds which can be advantageously employed for the process of this invention, several important ones will be recited hereinbelow:

Monofunctional acrylates, such as ethyl diglycol acrylate, hydroxypropyl acrylate, acrylic acid, ethyl acrylate, butyl acrylate, isobutyl acrylate, tert.-butyl acrylate, 2-ethylhexyl acrylate, lauryl acrylate, 2-hydroxyethyl acrylate, butanediol monoacrylate, 3-chloro-2-hydroxypropyl acrylate, dibromopropyl acrylate, diethylaminoethyl acrylate, dimethylaminoethyl acrylate, dihydrodicyclopentadiphenyl acrylate, benzyl acrylate, ethoxyethyl acrylate, 2-phenoxyethyl acrylate, cyclohexyl acrylate, benzil acrylate, bis (6-acryloxyhexyl)adipate, bis(2-acryloxyethyl)adipate.

Bifunctional acrylates, such as butanediol diacrylate, hexanediol diacrylate, triethylene glycol diacrylate, tetraethylene glycol diacrylate, neopentyl glycol diacrylate, 3-methylpentanediol diacrylate, ethylene glycol diacrylate, polyethylene glycol-/100/-, /200/-, and /400/diacrylate, propylene glycol diacrylate.

Trifunctional acrylates, such as trimethylpropane triacrylate, pentaerythritol triacrylate, and further polyfunctional acrylates, such as pentaerythritol tetraacrylate.

Methacrylates, such as N,N-dimethylaminomethyl methacrylate, methyl methacrylate, isobutyl methacrylate, n-butyl methacrylate, methacrylic acid, tetraethylene glycol dimethacrylate, ethylene glycol dimethacrylate, 1,3-butylene glycol dimethacrylate, ethyl methacrylate, trimethylolpropane trimethacrylate, n-hexyl methacrylate, 2-ethylhexyl methacrylate, decyl methacrylate, allyl methacrylate, 1,4-butanediol dimethacrylate, neopentyl glycol dimethacrylate, 2-hydroxyethyl methacrylate, 2-hydroxypropyl methacrylate, dimethylaminoethyl methacrylate, methacrylamide, bis(2-methacryloxyethyl)adipate, bis(3-methacryloxypropyl-)adipate, bis(4-methacryloxybutyl)adipate, bis(6-methacryloxybutyl)adipate, bis(6-methacryloxyhexyl)adipate, bis(10-methacryloxydecyl)adipate, bis(6-methacryloxyhexyl) malonate, bis(6-methacryloxyhexyl)phthalate, bis(2-methacryloxyethyl)phthalate, bis(2-methacryloxyethyl)isophthalate, bis(2-methacryloxyethyl)terephthalate, bis(10-methacryloxydecyl)sebacate.

The crosslinkable components, e.g. these reactive acrylates or methacrylates are added preferably to the synthetic resin molding composition of the sheet material and molded therewith into the sheet article, for example by extrusion or rolling or spread-coating. In this process, between 2% and 20% by weight of the reactive crosslinkable component is preferably provided, based on the total synthetic resin molding composition of the sheet material, but even smaller or also larger amounts are often effective along the lines of this invention. The synthetic resin molding composition of the sheet material can be based on the synthetic resins which can be processed with or which are compatible with the reactive components. Reactive components based on the mono- or polyfunctional acrylates or methacrylates are used, for example, advantageously for sheet materials obtained from synthetic resins based on vinyl chloride polymers, such as PVC (polyvinyl chloride) polyolefins, such as polyethylene, ethylene copolymers, or polypropylene, polystyrene, polyurethane, polycarbonate, ethylenepropylene terpolymers.

As explained in the foregoing, other compounds among the group of vinyl compounds can also be utilized, such as N-vinylpyrrolidone, vinyl propionate, vinyl acrylate, vinyl isobutyl ether, vinyl caprolactam, for purposes of this invention.

However, further suitable components capable of crosslinking, which can be used in this invention, preferably as base synthetic resin for the sheet are also prepolymers, such as unsaturated polyester resins, polyether acrylates, urethane acrylates, polyester acrylates, or epoxy acrylates and methacrylates, vinyl compounds and allyl compounds as prepolymers, acid-curable systems, and thiol/thiolene systems.

In case of sheet materials on the basis of polyvinyl chloride with plasticizer additive, it is advantageous to add to the PVC composition prior to manufacture of the sheet material, as the crosslinkable compounds, for example acrylates or methacrylates, or one of the following allyl compounds: allyl methacrylates, diallyl adipates, diallyl glycolates, diallyl itaconates, diallyl maleates, diallyl malonates, diallyl phthalates, diallyl sebacates, triallyl phosphates, triallyl phosphites, or triallyl cyanurates, or divinylbenzenes, glycerol trimethacrylates. After the molding of the sheet material, the application of the superficial pattern by means of a printing ink containing migrating dyes, and after the dye migration into the sheet material have been effected, the crosslinking reaction is triggered, for example by radiation with electron rays, whereby the dye migration is terminated and the dyes are fixed in the thus-attained position. Therefore, to conduct the process of this invention, there must be present on or in the molded part, at the time of application of the dyes to the molded part, still uncrosslinked, but crosslinkable compounds (components) which can then be crosslinked at the appropriate time.

It is possible by means of the process of this invention to dye sheet materials and/or the surfaces of molded articles of synthetic resin in a lightfast fashion and with sharp contours by imprinting patterns thereon. The capability of dyes to migrate is exploited. The migration of the dyes into the synthetic resin sheet material can be accelerated by heat, wherein temperature and time represent convenient control variables. They can be adapted to each other so that the dyes can penetrate in a controlled manner down to a desired migrating depth. It is even possible, in this connection, to slow down the rapid migration process by cooling to room temperature. The subsequent action of UV or electron rays on the crosslinkable components present and the thus-evoked crosslinking effect prevent suddenly and terminally any further migration of the dyes. Subsequent storage of sheet materials dyed in accordance with the invention, under the influence of heat, show, for example in an imprinted colored linear grid pattern, clearly the difference as compared with sheet materials which have not incurred subsequent crosslinking. The spacing of two imprinted lines in the crosslinked condition remains constant after storage under heat, whereas this spacing is extensively reduced in case of the uncrosslinked condition.

The process of this invention for the production of sheet materials of synthetic resin having a pattern which penetrates to a maximum extent, by the superficial application of colored patterns, can be combined with the manufacturing process of the sheet materials. For example, a synthetic resin composition containing still a proportion of an uncrosslinked, reactive component can be used to extrude a sheet; a colored pattern can be continuously applied to the thus-extruded sheet on its surface, wherein those dyes are used which migrate into the synthetic resin sheet and which are initially dissolved, for example, by a plasticizer contained in the synthetic resin sheet, whereby the migration is promoted; then this migration process is further enhanced and accelerated by allowing the patterned sheet to remain under elevated temperature; after reaching a predetermined migration depth of the colored pattern into the synthetic resin sheet, the temperature treatment is interrupted and the synthetic resin sheet is fed to an electron ray unit for crosslinking. The product obtained in this way is a sheet which can be dyed throughout its entire thickness in sharp contours of the pattern.

The process of this invention for the production of dyed, patterned sheet materials can also be combined with other manufacturing processes for the production of the synthetic resin sheet materials, for example with a spread-coating process with the use of synthetic resin pastes, wherein gelling methods are utilized for the manufacture of the sheet material. In this connection, a gelling process to be executed at an elevated temperature can be combined with the migration process of the dyes, for example.

The patterned sheet material produced according to the method of this invention can be utilized, for example as a layer in further composite materials. It is also possible to emboss the surface of the sheet material, in addition to the applied pattern, or optionally to provide the surface with a transparent cover layer. Such products can be preferably utilized for floor coverings.

Another suggestion advanced by the invention provides to embed the dye, capable of migration, between two sheet materials of synthetic resin and then to conduct the migrating step into the two adjoining sheets. In this way, the thickness of the pattern created by the dye application can be correspondingly enlarged with the simultaneous provision of a surface protection.

The invention will be explained hereinbelow with reference to several examples and to the FIGURE wherein a synthetic sheet material is shown schematically in a lateral view with sections covered with a dye coating.

A colored pattern dye 2 is applied to the sheet material 1 to cover a circular area on one surface thereof. The coating or layer of dye 2 and the synthetic resin of the sheet material 1 are adapted to each other in the composition of each so that the dyes contained in the dye coating 2 migrate into the sheet material 1. Section A shows the course of the migration without any additional influence, i.e. without crosslinking and without heating. The zone evolving in due course of time that is 3 months under room temperature by the migration of the dyes is indicated in shaded representation and denoted by 4, and the migrating directions are indicated by the arrows 3. This results in a region which flares in the form of a truncated cone having at the same time a diminishing dye concentration in the regions farther removed from the surface. One can imagine that after a corresponding period of time, the adjacent migration cones of the individual pattern application surface areas will reach one another and merge, unless the dye migration can be stopped.

The section denoted by B shows an almost cylindrical migration zone attained by a migration conducted with acceleration at elevated temperature, for example 12 min under 180° C., as compared to section A, and thereafter fixed in position by crosslinking. In such a course of the migration, a uniform dye concentration in the migration cylinder is furthermore achieved by applying heat during the migration process. When the migration has reached the desired depth, it is finally stopped by crosslinking the crosslinkable component or synthetic resin and so the pattern is fixed. With such a product, for example when the design is abraded on the surface by wear and tear, the pattern is yet preserved in the same color strength and contour.

In the embodiment of section C, in a deviation from the embodiment of section B, it is shown how the course of the migration can look if the migration is stopped prematurely by triggering crosslinking of the crosslinkable components in the sheet material 1 or in the printing ink sometime earlier in comparison with the process of section B. The migration time was 6 min under 180° C.

The following Example 1 describes the production of a sheet material on the basis of suspension PVC with additives, made from a paste by the spread-coating method in a spread-coating unit, which sheet material is provided with a design in accordance with the invention.

(In the examples, "parts" refers to parts by weight unless otherwise specified).

EXAMPLE 1

On asbestos paper as the substrate, a filled plastisol coating composition having a thickness of 1 mm. and containing the following ingredients is applied at room temperature and then cured by gelling or fusion at 210° C.:

| | Parts by Weight |
|---|---|
| E-PVC, K-value 70[1] | 65 |

-continued

| | Parts by Weight |
|---|---|
| Butylbenzyl phthalate plasticizer | 25 |
| Hexanediol diacrylate as crosslinkable component | 10 |
| Ba/Cd Stabilizer(2) | 2 |
| Filler, i.e. chalk | 20 |
| Pigment, i.e. $TiO_2$ | 3 |

(1)Vinol ® P 70 from Wacker GmbH, BRD
(2)Irgastab ® BC 100 from Siegle AG, BRD

By means of copper plate printing rotogravure, the solution of a migrating dye, e.g. Ceres Blue GN, is applied to the thus-obtained surface of the gelled or fused plastisol with a lining design and then dried at 60° C. to 1 minute. Suitable printing inks contain following ingredients:

10 to 30 parts binding material, like synthetic resins
89 to 50 parts solvent or mixture of solvents
1 to 20 parts dyes In the described process the following printing ink solution was utilized:

20 parts of polymethyl methacrylate, i.e. Deglan ® 51/04
40 parts of methyl isobutyl ketone
30 parts of ethyl glycol acetate
10 parts of toluene
2 parts of Ceres Blue GN The soft PVC sheet, coated superficially with a color design in this way, i.e. to a thickness less than 1$\mu$, is brought to a temperature of 160° C. for 3 minutes. During this time, the dye migrates to a depth of about 0.8 mm., i.e. vertically to the surface, into the soft PVC sheet. To fix the thus-obtained three-dimensional imprinted design, the crosslinkable hexanediol diacrylate added to the soft PVC and still in the uncrosslinked state is crosslinked by the effect of electron rays. The crosslinking takes place in a 1,500 kV plant with a radiation dose of 5 Mrad.

Storing the thus-treated and thus-obtained flat article in the form of sheet material under heat for 5 days and at 60° C. shows clearly that the migration of the dyes applied in a predetermined pattern as lines was stopped, whereas in case of a flat article of the same batch but without the conductance of crosslinking the migration progresses further.

The measuring of two imprinted lines having a spacing of 1.1 mm. showed, after the above-described storage, that there was still the same spacing of 1.1 mm. measured prior to storage in case of a crosslinked flat article, while in case of the uncrosslinked flat article, after it was subjected to storage under heat at 60° C. and for 5 days, there remained merely a spacing of 0.7 mm.

EXAMPLE 2

The transparent PVC paste batch set forth hereinbelow is applied in a thickness of about 0.5 mm. on release paper and then gelled at 210° C. for 3 minutes.

| | Parts by Weight |
|---|---|
| E-PVC, K-value 70 | 70 |
| Dioctyl phthalate plasticizer | 20 |
| Lauryl acrylate as the crosslinkable component | 10 |
| Ba/Cd Stabilizer(1) | 2 |
| Benzil dimethyl ketal (photoactivator) | 3 |
| Hexanediol diacrylate as crosslinkable component | 7 |

(1)Same stabilizer as employed in Example 1

By means of screen printing, a pattern is applied to the thus-gelled film. A migrating dye, e.g. Teraprint ® red 3 G, is dissolved in a dispersion printing ink used for this purpose The dispersion printing inks suitable for the invention normally contain 30 to 40 parts binding material
5 to 10 parts dyes
3 to 8 parts thickener
0.1 to 0.2 parts ammonia
61.9 to 41.8 parts water The following printing ink solution was employed:

| | Parts by Weight |
|---|---|
| Acrylate copolymer dispersion i.e. Acronal ® LR 8381 | 55 |
| Collacral ® U, thickener(1) | 5 |
| Ammonia | 0.1 |
| Water | 10 |
| Teraprint ® red 3 G(2) | 5 |

(1)BASF, BRD
(2)Ciba Geigy, CH

Another 0.5 mm. of transparent PVC paste having the above recipe is applied to the dried varnish film and gelled at 200° C. for 2 minutes.

During the gelling step, the dye migrates uniformly in the upward and downward directions into the soft PVC layers. The fixation of the printed design takes place herein by crosslinking with the use of four UV radiators having a power of respectively 80 W/cm. at a velocity of 4 m./min.

A strip of color having a width of 1.5 mm. after gelling no longer expands in case of the crosslinked sample during a heat storage for 10 days at 60° C., whereas in case of the uncrosslinked sample having the same composition an expansion of the strip to 2.3 mm. was measured, caused by additional migration.

EXAMPLE 3

A rough PVC sheet is produced by rolling from the following formulation:

| | Parts by Weight |
|---|---|
| S-PVC, K-value 68 | 46 |
| Dioctyl phthalate plasticizer | 10 |
| Trimethylolpropane triacrylate as crosslinkable component | 10 |
| Filler, i.e. chalk | 30 |
| $TiO_2$ | 5 |
| Ba/Cd Stabilizer(same as in Example 1) | 1 |

With a screen-printing unit, a predetermined pattern is imprinted in colors on this sheet. As the dye carrier for the dye Teraprint ® red 3 G, an aqueous varnish solution is utilized, i.e. that disclosed in Example 2. After the printing ink has dried, the dye is caused to migrate into the rough sheet by 30 minutes of heat storage under 100° C. The dye is fixed, and thus the migration of the dye is stopped, by the crosslinking of the trimethylolpropane triacrylate with a radiation dose of 5 Mrad. on a 1,500 kV electron ray unit.

The depth of penetration of the dye is, after heat storage, 600μ prior to crosslinking. In case of the crosslinked sample, the thus-attained depth of penetration no longer changes even upon additional heat storage for 5 days at 60° C. In case of the uncrosslinked sample, the dye continues its migration upon heat storage, to a depth of more than 2,000μ after 5 days at 60° C.

EXAMPLE 4

| | Parts by Weight |
|---|---|
| E-PVC, K-value 70 | 65 |
| Dioctyl phthalate | 35 |
| Ba/Cd Stabilizer* | 2 |

*Irgastab® BC 103 from Siegle AG, ARD

A transparent sheet made from the above formulation is imprinted with the following printing ink recipe by the copper-plate printing rotogravure process:

| | Parts by Weight |
|---|---|
| "Laromer" LR 8497 X | 16.42 |
| Butanediol diacrylate | 74.63 |
| Hexanediol diacrylate | 5.24 |
| Benzil dimethyl ketal | 2.22 |
| Methyl isobutyl ketone | 5.00 |
| Fat Red 5 B | 5.00 |

Laromer LR® is a commercially available, highly viscous prepolymer of unsaturated acrylate dissolved in ethyldiglycolacrylate; butanediol diacrylate and hexanediol diacrylate are utilized as diluent and crosslinkable components; benzil dimethyl ketal is a photoactivator; methyl isobutyl ketone is a solvent to promote the migration of the dye utilized, namely Fat Red 5 B.

The thus-imprinted sheet is exposed to a temperature of 180° C. for 5 minutes. During this time, a portion of the dye as well as a portion of the crosslinkable components migrate into the material. After the desired migration depth has been reached, e.g. 1000μ, crosslinking is effected by means of UV rays as in Example 2, and thus the dye is fixed within the sheet.

The blockage effect of the crosslinkable components which are thereafter crosslinked to arrest the migration of the dyes in the flat article is also dependent on the degree of crosslinking which has been attained. The Shore hardness is a relative standard for the crosslinking density achieved in the irradiated flat article and thus is a determining criterion for the fixation of the dyes, wherein the rise in Shore hardness from the uncrosslinked to the crosslinked sample renders a measurable value.

In the following examples the Shore hardness and the rise in Shore hardness are measured with the use of differently crosslinking and crosslinked components and at differing radiation doses, to show the varying degree of crosslinking of the samples. Consequently, this procedure provides means for establishing how the degree of crosslinking can be controlled depending on the purpose for which the sheet material provided with a pattern according to this invention is to be utilized.

EXAMPLE 5

Sheets having a thickness of 2 mm. were produced with various crosslinking substances from a formulation of:

| | Parts by Weight |
|---|---|
| E-PVC, K-value 70 | 61.23 |
| Butyl benzyl phthalate | 25.51 |
| Ca—Zn Stabilizer* | 3.06 |
| Crosslinking substance, see Table I | 10.20 |

*Interstab® M 3255 from Akzo, NL

The Shore hardness of the uncrosslinked and of the crosslinked samples with differing crosslinking substances was measured at varying doses of radiation; the values are indicated in Table I.

TABLE I

| Crosslinking Substance | SHORE HARDNESS at | | | | |
|---|---|---|---|---|---|
| | Uncrosslinked | 3 Mrad. | 5 Mrad. | 7 Mrad. | Max. Δ |
| Lauryl acrylate | 75 | 81 | 85 | 82 | 10 |
| Hexanediol diacrylate | 74 | 88 | 91 | 94 | 20 |
| Pentaerythritol triacrylate | 77 | 94 | 96 | 94 | 19 |
| Lauryl methacrylate | 77 | 82 | 83 | 82 | 6 |
| Polyester acrylate (Ebecryl 554) | 78 | 85 | 86 | 85 | 8 |
| Epoxy acrylate (Derakane XD 8008.4) | 83 | 91 | 92 | 91 | 9 |
| Urethane acrylate (UVE 77) | 85 | 90 | 91 | 91 | 6 |
| Thio/ene System (9061 C) | 77 | 84 | 85 | 85 | 8 |

The migrating velocity of the dyes in the flat article is dependent, inter alia, on:

(a) type and amount of dye;
(b) type and amount of plasticizer;
(c) type and amount of crosslinkable component;
(d) degree of gelling of the batch in case of synthetic resin pastes;
(e) type and amount of fillers;
(f) temperature.

The migration is controlled and fixed especially by the conducting of the temperature and by the initiating of the crosslinking.

EXAMPLE 6

In this example, the migration velocity of dyes in dependence on the type and amount of dye was measured at a constant temperature, with the penetration depth in μ after 2, 6, 12, and 20 minutes. In this connection, the dye was applied according to the copper-plate printing rotogravure method with a raster plate 54 to a flat article in the form of a sheet having the following formulation:

| | Parts by Weight |
|---|---|
| E-PVC, K-value 68 | 36 |
| Dioctyl sebacate as the plasticizer | 16 |
| Crosslinkable component: hexanediol diacrylate | 5 |

-continued

| | Parts by Weight |
|---|---|
| Sn Stabilizer* | 2 |
| Chalk | 37 |
| $TiO_2$ | 4 |

*Stanclair® TM from Akzo, NL

The printing ink had the following composition (excluding the dye component):

| | Parts by Weight |
|---|---|
| Varnish PVC, K-value 55 | 12 |
| Methyl isobutyl ketone | 30 |
| Toluene | 30 |
| Ethyl glycol acetate | 20 |
| Cyclohexanone | 8 |

Table II below indicates the varying penetration depths in case of differing dyes and dye concentrations.

TABLE II

| Dye | Dye Concentration Parts by Weight Based on Total Varnish Batch | Penetration Depth in μ After 2 min. 180° C. | 6 min. 180° C. | 12 min. 180° C. | 20 min. 180° C. |
|---|---|---|---|---|---|
| Thermoplast Red | 6 | 100 | 200 | 500 | 600 |
| Thermoplast Red | 12 | 100 | 250 | 500 | 700 |
| Thermoplast Red | 18 | 150 | 200 | 500 | 800 |
| Ceres Blue GN | 6 | 350 | 400 | 700 | 1200 |
| Ceres Blue GN | 12 | 350 | 450 | 800 | 1100 |
| Ceres Blue GN | 18 | 300 | 500 | 1000 | 1300 |
| Ceres Yellow 3 G | 6 | 400 | 500 | 850 | 1000 |
| Ceres Yellow 3 G | 12 | 400 | 550 | 900 | 1100 |
| Ceres Yellow 3 G | 18 | 500 | 600 | 950 | 1400 |

EXAMPLE 7

The migrating velocity of the dyes can be greatly influenced by the type and quantity of plasticizer. Sheets were prepared from a formulation corresponding to Example 6, the plasticizers of which vary in accordance with Table III; these sheets were imprinted with a colored pattern; and the penetration depth of the dyes on account of migration was measured at varying temperatures and after differing periods of migration. The following Table III illustrates the result. For the dye application, a formulation according to Example 6 was employed. The migration zones reached were thus like section C of FIG. 1.

TABLE III

| Type of Plasticizer | Penetration Depth in μ After 20° C. 24 h | 60° C. 2 h | 60° C. 3 h | 60° C. 4 h | 100° C. 2 h | 100° C. 3 h | 100° C. 4 h | 120° C. 2 h | 120° C. 3 h | 120° C. 4 h |
|---|---|---|---|---|---|---|---|---|---|---|
| Butyl benzyl phthalate | 100 | 200 | 200 | 250 | 600 | 600 | 800 | 900 | 1100 | >2000 |
| Dioctyl phthalate | 200 | 300 | 350 | 400 | 600 | 850 | 900 | 1000 | 1100 | >2000 |
| Diisodecyl phthalate | 200 | 300 | 350 | 350 | 600 | 700 | 900 | 1000 | 1200 | >2000 |
| Dioctyl adipate | 400 | 500 | 600 | 600 | 900 | 1000 | 1100 | 1100 | 1400 | >2000 |
| Dioctyl sebacate | 500 | 500 | 700 | 700 | 900 | 1100 | 1500 | 1000 | 1200 | >2000 |

EXAMPLE 8

The effect on the migrating velocity of the dyes by the type and quantity of crosslinkable components and type and quantity of filler was examined on samples consisting of a basic formulation as follows:

| | Parts by Weight |
|---|---|
| E-PVC, K-value 70 | 36 |
| Crosslinkable component | 1–10.2 |
| Chalk | 10–36 |
| Butyl benzyl phthalate | 11–20 |
| Sn Stabilizer* | 2 |

*Stanclair® TM from Akzo, NL

Table IV shows the penetration depth in μ of the imprinted dyes in case of various monomers and varying monomers contents and filler contents and in dependence on the migration period and the temperatures. The dye applied was a formulation according to Example 6.

TABLE IV

| Type of Monomer | Monomer Content Parts by Weight | Filler Content Parts by Weight | Penetration Depth in μ 7 Days RT | 24 h 90° C. | 7 Days 60° C. | 14 Days 60° C. |
|---|---|---|---|---|---|---|
| Lauryl acrylate | 10.2 | 0 | — | 1000 | 1500 | >2000 |
| Hexanediol diacrylate 1 | 10.2 | 0 | — | 800 | 1400 | 1500 |
| Pentaerythritol triacrylate | 10.2 | 0 | — | 600 | 1100 | 1300 |
| Lauryl methacrylate | 10.2 | 0 | — | 1300 | >2000 | >2000 |
| Lauryl acrylate | 9.25 | 9.25 | — | 1300 | >2000 | >2000 |
| Hexanediol diacrylate | 9.25 | 9.25 | — | 1200 | >2000 | >2000 |
| Pentaerythritol triacrylate | 9.25 | 9.25 | — | 900 | 1100 | 1200 |
| Lauryl methacrylate | 9.25 | 9.25 | — | 1500 | 1700 | >2000 |
| Hexanediol diacrylate | 1 | 36.3 | 150 | — | — | — |
| " | 2 | 36.3 | 200 | — | — | — |
| " | 3 | 36.3 | 300 | — | — | — |
| " | 5 | 36.3 | 300 | — | — | — |
| " | 10 | 36.3 | 400 | | | |

EXAMPLE 9

If the synthetic resin sheet material is produced by way of pastes subjected to a gelling step, the migration of the dyes can be combined with the gelling process. The plastisol batch set forth in Example 1 was applied to release paper, initially gelled (gelled sufficient to provide a printable surface), and imprinted with a colored pattern in the manner indicated in Example 1, whereupon it was finally gelled at varying temperatures. Here again, the dependence of the migrating velocities and depth of penetration on the temperature and time has been indicated in Table V.

TABLE V

| | Penetration Depth in μ | | | | | |
|---|---|---|---|---|---|---|
| Gelling Conditions | Time: 2' Temp.: 210° | 5' 210° | 8' 210° | 2' 140° | 3' 140° | 8' 140° C. |
| Initial gelling at 140° C. for 3 minutes | 400 | 600 | 900 | 150 | 200 | 300 |
| Gelling completed at 210° C. for 3 minutes | 100 | 500 | 800 | 50 | 150 | 200 |

EXAMPLE 10

By means of rolling, a sheet is produced from a composition containing:

| | Parts by Weight |
|---|---|
| BUNA AP 447[1] | 100 |
| Sillitin N 82[2] | 100 |
| Stearic acid | 1 |
| Escorez 5280[3] | 5 |
| Sunpar 150[4] | 40 |
| $TiO_2$ RN 57 p | 10 |
| Trimethylolpropane Trimethacrylate | 5 |

[1]from Hüls, AG, BRD
[2]Handelsgesellschaft Hoffman & Söhne, (calciniertes Silikat) BRD
[3]ESSO, FR
[4]Sunoil Antwerpen, NL This sheet is imprinted with a printing ink according to the procedure of Example 1 by the copper-plate printing rotogravure method. Then the migration of the dye is evoked by raising the temperature to 170° C. over a period of 3 minutes. The depth of dye penetration is, after this treatment, 400μ. The further migration of the dye is stopped by vulcanizing and crosslinking. This is effected by means of a 1,500 kV electron ray unit at a dose of 16 Mrad.

EXAMPLE 11

The PVC paste formulation recited hereinbelow, containing a methacrylate as the crosslinking compound and a peroxide as the startup agent is spread in the form of a sheet and initially gelled at 120° C.

| | Parts by Weight |
|---|---|
| PVC Copolymer | 41.15 |
| E-PVC, K-value 70 | 8.23 |
| Butyl benzyl phthalate | 20.58 |
| Dioctyl phthalate | 20.58 |
| Sn Stablilizer[1] | 0.41 |
| Pleximon 773[2] | 8.23 |
| Triganox B[3] | 0.82 |

[1]Stanclair® TM from Akzo, NL
[2]Röhm GmbH, BRD
[3]Akzo, NL

The thus-obtained sheet is imprinted with a printing ink according to Example 1 and then gelled and crosslinked for 5 minutes at 210° C. For comparison, an uncrosslinked sheet is produced from the same batch and imprinted in the same way. Due to the crosslinking action, the Shore A hardness rises from 45 in case of the uncrosslinked sheet to 57.

After a storage period of 48 hours at 60° C., the dye in the uncrosslinked sample has penetrated another 1.2 mm. deeper into the sheet, whereas in case of the crosslinked sample no further dye migration was determined.

What is claimed is:

1. A process for the production of a synthetic resin sheet material having a unicolored or multicolored dye coating applied to at least a selective portion of one surface thereof, said dye coating penetrating uniformly into said sheet material, which comprises applying a dye-containing material to at least one selective portion of a surface of a synthetic resin sheet material, said synthetic resin sheet material containing at least one reactive, crosslinkable component that crosslinks with itself or with another crosslinkable component contained in said synthetic resin sheet material, and said dye-containing material being capable of migrating into a non-porous sheet formed of said synthetic resin sheet material; controlling the migration of the dye-containing material into the sheet material to a desired depth of penetration; then initiating crosslinking of said at least one crosslinkable component contained in said sheet material and crosslinking said at least one crosslinkable component to a different degree, within said synthetic resin sheet material, to stop further migration of the dye-containing material into said sheet material.

2. A process according to claim 1, wherein the dye-containing material contains an organic dye.

3. A process according to claim 2, wherein the organic dye is a soluble organic dye.

4. A process according to claim 1, wherein auxiliary agents which partially dissolve the dye within said dye-containing material are added to the sheet material prior to application of said dye-containing material to said synthetic resin sheet material, so that the migration of the dye is enhanced.

5. A process according to claim 1, wherein the dye-containing material is applied as a color application to the surface of the sheet material in a solution or dispersion by a direct printing or transfer printing operation.

6. A process according to claim 1, wherein the migration of the dye is controlled by heating the dyed sheet material at temperatures of 60°–220° C. to accelerate the migration.

7. A process according to claim 1, wherein the crosslinkable, reactive component contains reactive double bonds.

8. A process according to claim 1, wherein the crosslinkable component is crosslinkable by electromagnetic radiation including ultraviolet rays or electron rays and the crosslinking is initiated by irradiation of the sheet material coated with the dye-containing material.

9. A process according to claim 8, wherein the crosslinkable component is a synthetic resin selected from the group consisting of polypropylene, polystyrene, polyethylene, polyester, polybutadiene, polysiloxane, EPDM, natural rubber, synthetic rubber, polyvinyl chloride, polyvinyl alcohol and a polyacrylate.

10. A process according to claim 8, wherein the crosslinkable component is a vinyl compound.

11. A process according to claim 10, wherein the vinyl compound is a monofunctional acrylate, polyfunctional acrylate, or mixture thereof or a methacrylate or a mixture thereof with one of said acrylates.

12. A process according to claim 7, wherein the crosslinkable component comprises prepolymers.

13. A process according to claim 1, wherein the proportion of crosslinkable component, based on the total weight of the sheet material, is between 2 and 80% by weight.

14. A process according to claim 1, wherein the proportion of crosslinkable component, based on the total weight of the sheet material, is between 2 to 20% by weight.

15. A process according to claim 1, wherein the dye-containing material is applied as a layer to the surface of said synthetic resin sheet material that contains the crosslinkable component and thereafter another synthetic resin sheet material containing a crosslinkable component is placed over the layer of said dye-containing material so that the dye-containing material is embedded between the two sheet materials and migration is controlled to take place into both of said sheet materials.

16. A process according to claim 3 wherein the organic dyes are anthraquinone dyes, azo dyes or diazo dyes.

17. A process according to claim 6 wherein the heating of the colored sheet material takes place for at least 1 min until 1 hour.

18. A process according to claim 4 wherein said auxiliary agents comprise plasticisers.

19. A process according to claim 18 wherein the sheet material is soft polyvinyl chloride.

20. A process according to claim 19 wherein the plasticisers are based on phthalates, adipates or sebacates.

21. A process according to claim 1 wherein the crosslinkable component promoting the dye migration is on acrylate.

22. A process according to claim 1, wherein the migration of the dyes is stopped by crosslinking the crosslinkable component to effect an increase of the shore hardness of the sheet material by at least 5%, measured prior to and after the crosslinking.

23. A process according to claim 1, wherein the migration of dye-containing material into the synthetic resin sheet material is controlled by waiting a prescribed period after application of the dye-containing material onto the surface of said synthetic resin sheet material before initiating crosslinking of said crosslinkable component.

24. A process according to claim 1, wherein the migration of the dye is accelerated by heating the colored sheet material at temperatures of 150° to 200° C.

25. A process according to claim 1, wherein said at least one reactive crosslinkable component is selected from the group consisting of monomeric, oligomeric and polymeric components and mixtures thereof which are polymerized during said crosslinking.

26. A process according to claim 1, wherein auxiliary agents which partially dissolve the dye within said dye-containing material are added to the dye-containing material to be applied, so that migration of the dye is enhanced in the presence of said auxiliary agents.

27. A process according to claim 1, wherein crosslinkable components, which promote the dye migration, are contained in the sheet material.

* * * * *